US007154815B2

(12) United States Patent
Born et al.

(10) Patent No.: US 7,154,815 B2
(45) Date of Patent: Dec. 26, 2006

(54) ASTRONOMICAL TIMEPIECE

(75) Inventors: Jean-Jacques Born, Morges (CH); Raymond Froidevaux, Boudry (CH)

(73) Assignee: Asulab S.A., Marin (CH)

( * ) Notice: Subject to any disclaimer, the term of this patent is extended or adjusted under 35 U.S.C. 154(b) by 131 days.

(21) Appl. No.: 10/886,100

(22) Filed: Jul. 8, 2004

(65) Prior Publication Data

US 2005/0013198 A1 Jan. 20, 2005

(30) Foreign Application Priority Data

Jul. 14, 2003 (EP) ..... 03015970

(51) Int. Cl.
*G04B 49/00* (2006.01)

(52) U.S. Cl. ..... 368/15; 368/80; 368/228

(58) Field of Classification Search ..... 368/80, 368/150, 15, 16–20, 223; D10/127–128
See application file for complete search history.

(56) References Cited

U.S. PATENT DOCUMENTS

| | | | | |
|---|---|---|---|---|
| 4,731,767 | A * | 3/1988 | Uehara | 368/15 |
| 5,572,489 | A | 11/1996 | Born et al. | |
| 6,272,076 | B1 * | 8/2001 | Dinger | 368/15 |
| 6,330,207 | B1 | 12/2001 | Born et al. | |
| 2004/0120222 | A1 | 6/2004 | Born et al. | |

FOREIGN PATENT DOCUMENTS

| | | |
|---|---|---|
| EP | 0 738 944 A1 | 10/1996 |
| EP | 0 949 549 A1 | 10/1999 |
| EP | 0952 426 A1 | 10/1999 |
| EP | 1431846 | 6/2004 |
| WO | WO 97/01161 | 1/1997 |

OTHER PUBLICATIONS

European Search Report, completed Mar. 8, 2004.
Jean Meeus, "Astronomical Algorithms," 1991, pp. 205 to 246, Willmann-Bell Inc., Richmond, Virginia.
Landholt-Borstein, Numberical Data and Functional Relationships in Science and Technology, Group VI, vol. I, 1965, pp. 62 to 82, Spring Verlag, Berlin, Germany.

* cited by examiner

*Primary Examiner*—David M. Gray
*Assistant Examiner*—Sean Kayes
(74) *Attorney, Agent, or Firm*—Griffin & Szipl, P.C.

(57) ABSTRACT

The present invention concerns an electronic astronomical watch, in particular of the wristwatch type, said watch (1) being capable of indicating the position of celestial bodies in the heavens, said watch (1) including:

a time base (48) for producing a standard frequency signal;

means (50) for determining the current time and date from the standard signal means (28, 30) for selecting a celestial body;

analogue time display means using two hands (10, 12);

means (32) for determining the position of the selected celestial body in the heavens and indicating this position via the display means (10, 12), the watch (1) being wherein it includes a rotating dial (14) on which there is shown the map (16) of the heavens and in that the shape of the hands (10, 12) is such that their intersection or point of conjunction enables any point of the map of the heavens (16) to be designated on the dial (14).

14 Claims, 3 Drawing Sheets

ASTRONOMICAL TIMEPIECE

This application claims priority from European Patent Application No. 03015970.1 filed Jul. 14, 2003, the entire disclosure of which is incorporated herein by reference.

FIELD OF THE INVENTION

The present invention concerns a timepiece such as a wristwatch of the astronomical type, i.e. a watch capable of indicating the position of a celestial body of the solar system with respect to the Earth and to the constellations of the zodiac.

BACKGROUND OF THE INVENTION

A watch answering this definition is disclosed in European Patent No. 0 949 549 in the name of the Applicant. This watch includes in particular an hour hand and a minute hand, which move above a dial, which carries at its periphery an hour and minute scale and inside the latter, the symbols of the twelve signs of the zodiac. This watch also includes a rotating bezel bearing the symbols of the planets of the solar system. When the user wishes to know the position of a planet of the solar system with respect to the constellations of the zodiac, he rotates the bezel until the symbol of the celestial body that interests him is at 12 o'clock and he then presses the crown of a control stem. At that moment, the minute hand moves until it is placed in the position in which it indicates the celestial body in question and the approximate position thereof inside said zodiac sign, using the twelve signs of the zodiac and the hour and minute scale of the watch dial. If he so wishes, the user can repeat the same operations for one or several other celestial bodies.

The major drawback of the astronomical watch described hereinbefore lies in the fact that it is not able to provide information allowing its user simply and quickly to find the position in the heavens of the celestial body that interests him. Indeed, this watch only provides an indication of the position of a given celestial body of the solar system with respect to the zodiac constellations. If the user then wishes to see the celestial body in question in the heavens, he will have to first of all identify the zodiac constellation designated for said body by his the watch. This assumes that the user is able to recognize the groups of stars corresponding to the various zodiac constellations, which is not within everyone's capabilities.

It is an object of the present invention to overcome the aforementioned problem in addition to others by providing a watch, particularly a wristwatch, which enables a user to know at any time, when he so wishes, the position of a celestial body in the heavens and to be able easily to identify the position of said body in the heavens, without this requiring any particular astronomical knowledge on the user's part.

SUMMARY OF THE INVENTION

The present invention therefore concerns an electronic astronomical watch, in particular of the wristwatch type, this watch being capable of indicating the position of celestial bodies in the heavens, said watch including:

a time base for producing a standard frequency signal;

means for determining the current time and date from the standard signal;

means for selecting a celestial body;

means for determining the position of the celestial body in the heavens and indicating this position via the display means, the watch being characterized in that it includes a rotating dial on which there is represented a map of the heavens and in that the shape of the hands is such that their intersection or their point of conjunction allows any point of the map of the heavens shown on the dial to be indicated.

According to a complementary feature of the invention, the map of the heavens is a diagram of the constellations, particularly the twelve constellations of the zodiac and the stars visible from the earth.

Owing to these features, the present invention provides an astronomical watch, which enables its user, not only to know the position of a celestial body with respect to the stars and constellations of the Milky Way, but also to know the position of the stars and constellations in the heavens. The user can thus, without needing any particular astronomical knowledge, identify, at the moment he so wishes, the position of the celestial body that interests him.

According to another feature of the invention, the astronomical watch enables the position of the planets of the solar system to be identified.

According to yet another feature, the watch includes a glass on which a horizon line is shown, which indicates to the user, at any time, the portion of the heavens that is visible from the place where he is situated.

Owing to this further feature, identification of the celestial body of the solar system or any other celestial body, which interests the user, is made even simpler.

According to yet another feature, the watch dial which carries the map of the heavens makes one complete revolution in 23 hours 56 minutes 4.09 seconds.

The watch dial thus completes one revolution in a little less than 24 hours, to take account of the fact that the earth rotates around the sun in one year. The dial would make one complete revolution in 24 hours if one ignored the movement of the earth around the sun in one year, but in reality requires an adjustment of 3.94 minutes less, if one considers that one year equals 365.24 days, to take account of the contribution of 0.24 days of leap years. The watch is thus capable of determining, at the user's request, the positions of the various celestial bodies of the solar system with respect to the constellations at a determined date. Likewise, the watch is capable permanently of determining the position of the constellations in the heavens.

BRIEF DESCRIPTION OF THE DRAWINGS

Other features and advantages of the present invention will appear more clearly from the following detailed description of an example embodiment of the astronomical watch according to the invention, this example being given purely by way of illustrative and non-limiting example, with reference to the annexed drawing, in which.

DETAILED DESCRIPTION OF THE INVENTION

The present invention proceeds from the general inventive idea consisting in providing an astronomical watch, which enables its user to identify, when he so wishes, the position of a celestial body in the heavens. Thus, the astronomical watch according to the invention essentially includes a rotating dial on which the map of the stars and the constellations is represented and a pair of hour and minute hands, whose shape is such that their point of intersection or conjunction allows any of the stars or constellations shown on the dial to be designated. After having selected the celestial body whose position he wishes to know, the user then need only consult the dial of his watch on which the point of intersection of the hands indicates to him in which constellation the celestial body that interests him is located. The fact that the dial carries a diagram of the heavenly vault visible from the place where the user is located enables him to easily identify the position of the celestial body that he is seeking in the heavens without needing any particular astronomical knowledge.

In the following description, reference will be made to the identification of the position of the planets of the solar system in the heavens. It will be understood, however, that the invention is not limited to this embodiment and that it enables the position of any celestial body, such as a comet, or even an artificial satellite, to be identified.

Figure 1:
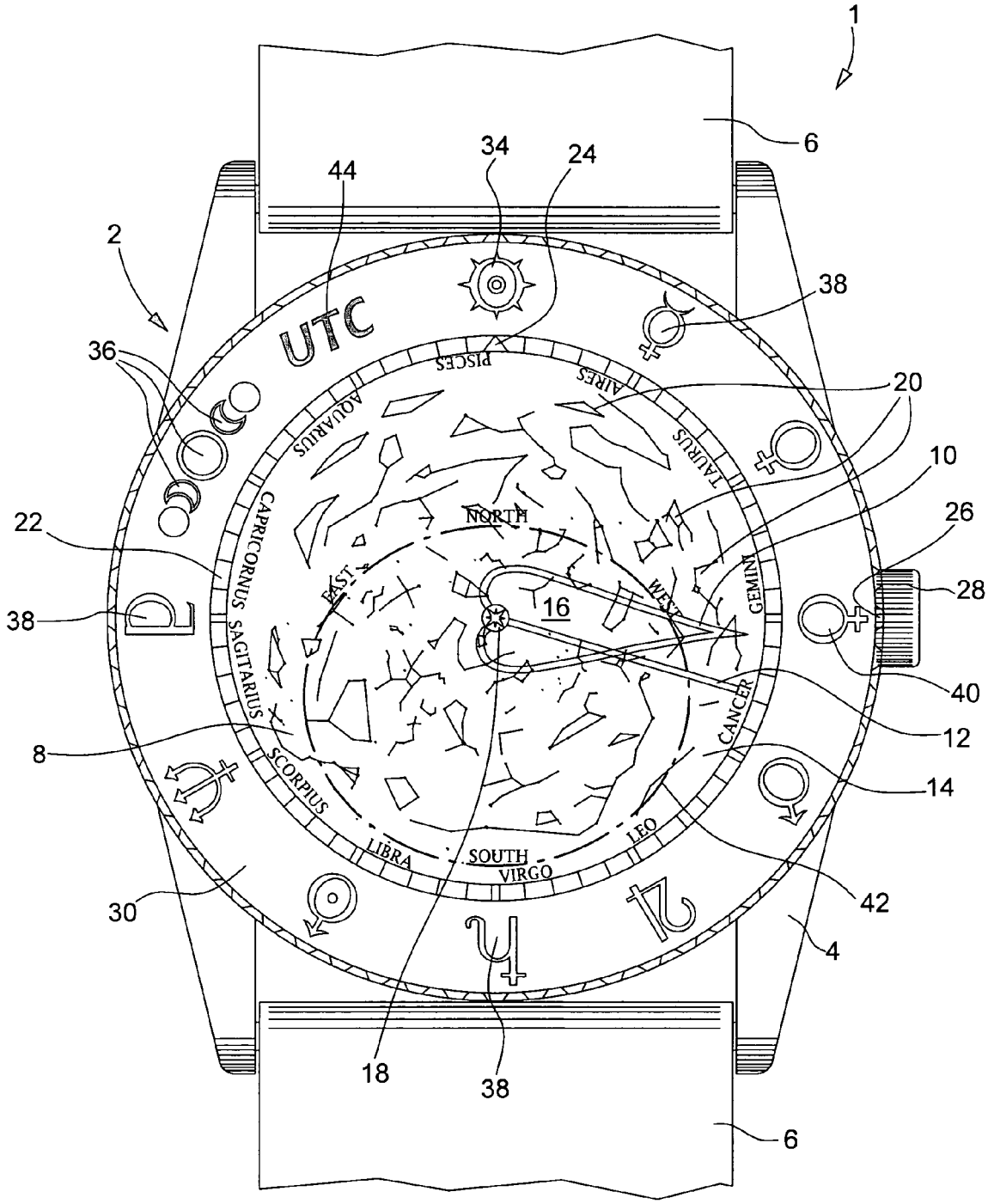
FIG. 1 is a plain view of the astronomical watch according to the present invention.

FIG. 1 shows a particular embodiment of the watch according to the invention.

Designated as a whole by the general reference numeral 1, the watch of FIG. 1 is a wristwatch with an analogue display, which includes, in a conventional manner, a case 2 formed by a middle part 4 to which the two ends or two strands of a wristband 6 are attached, a glass 8, fixed to the front of this middle part 4 and a back cover, not visible in the drawing, which may be removable or provided with a hatch for introducing and changing a battery, which acts as the supply voltage source for watch 1.

The display means of watch 1 include an hour hand 10 and a minute hand 12, which are each driven by a two-directional stepping motor and via a suitable gear train.

These two hands 10 and 12 move above a rotating dial 14, which is driven by a third stepping motor in the two rotational directions via a suitable gear train. This dial 14 rotates about the same axis as hands 10 and 12 and completes one revolution in the anti-clockwise direction in a little less than 24 hours, very precisely 23 hours, 56 minutes and 4.09 seconds, in order to take account of leap years.

According to one feature of the invention, a map of the heavens 16 is shown on dial 14. As the watch shown in FIG. 1 is intended to be used in the northern hemisphere, the map of the heavens 16 shown on dial 14 corresponds to the order of the constellations as seen on a latitude of 45° north, with the pole star 18 at the center of said dial 14. Of course, for a watch intended to be used in the southern hemisphere, the heavens will be shown as they are seen on these latitudes.

As can be seen upon examining FIG. 1, constellations 20, in particular the zodiac constellations, are not shown on dial 14 by their names or by pictograms, but by the star aggregates of which they are formed. The user thus permanently has available a complete map of the heavens as seen from the place where he is situated and which will be useful to him when he wishes to identify the position of a celestial body of the solar system, as will be explained in detail hereinafter.

The Latin names of the twelve constellations of the zodiac are indicated on the periphery of rotating dial 14. In order to allow the user to better distinguish the constellations of the zodiac, the latter could be shown in another color or with a thicker line than the other constellations appearing on the map of the heavens 16.

Dial 14 moves facing a fixed scale 22 graduated with the hours and minutes and carrying a mark 24 placed at midday. This scale 22 surrounds dial 14 and is carried by a flange.

In the particular embodiment of the invention shown in FIG. 1, the means for selecting a celestial body of the solar system include a control stem 26 provided with a crown 28 and a rotating bezel 30.

Control stem 26 is a rotating stem, which can be moved axially between three positions, namely a stable neutral position, which corresponds to the normal operating position of the watch, a pulled out position that is also stable and an unstable pushed-in position in which a return spring permanently tends to return the stem to the neutral position.

Figure 3:
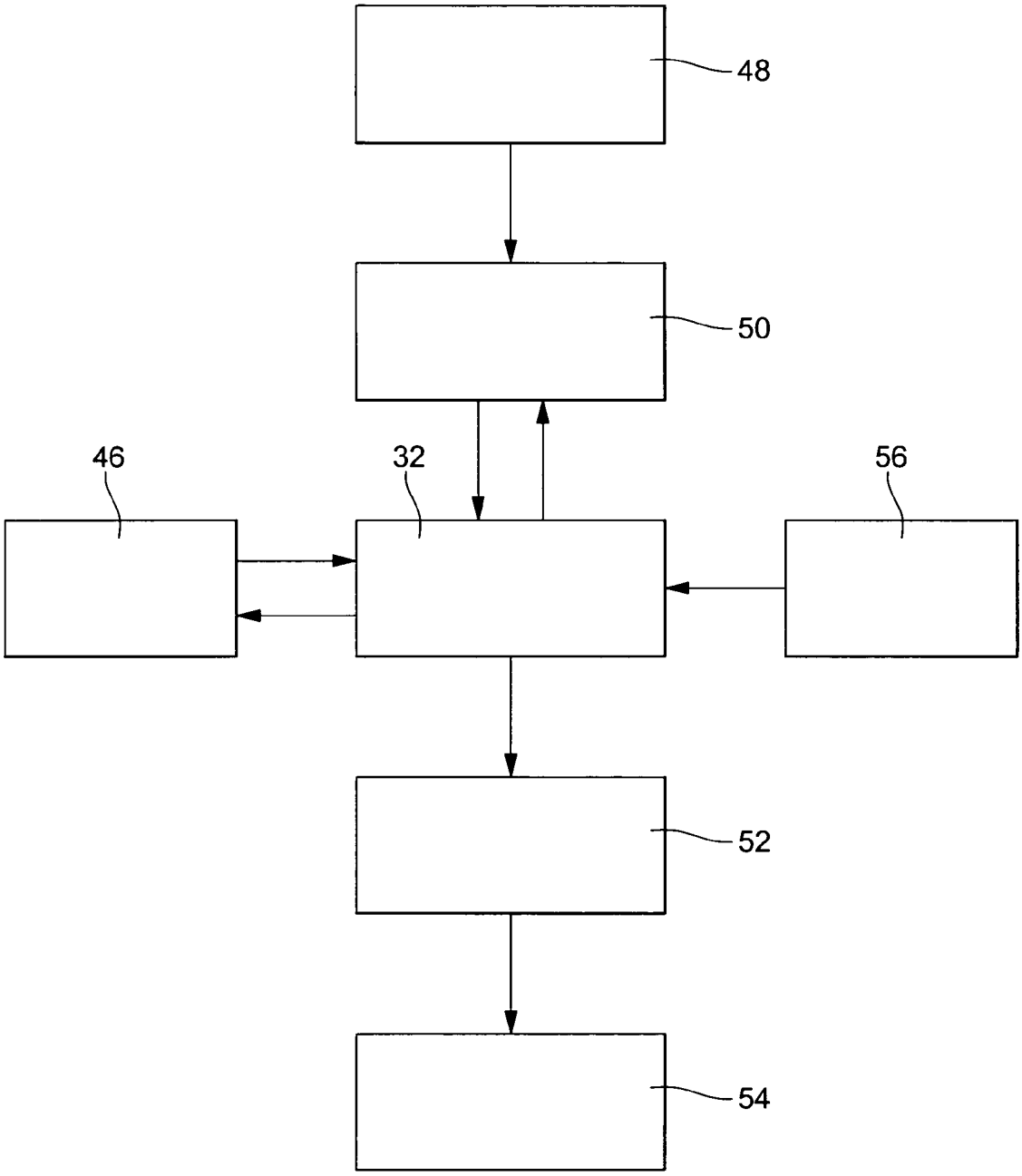
FIG. 3 is a block diagram illustrating the various functions of the watch shown in FIG. 1.

The axial and rotating movements of stem 26 are converted by switches into characteristic electric signals, which are sent to a control unit 32 (see FIG. 3) of the watch 1.

As regards the rotational movements, these electric signals are pulse trains that allow the control unit to determine in which direction the stem has been rotated and whether the rotational speed is less or greater than a certain value, in other words whether the stem is being rotated slowly or quickly.

Rotating bezel 30 is arranged such that fixed scale 22 is disposed concentrically between the rotating dial 14 and said bezel 30. This bezel 30 bears the symbols for the sun at 34, the moon at 36 and the various planets of the solar system at 38 including the earth at 40.

The position of bezel 30 can be detected by any known device connected to control unit 32, like for example that described in European Patent No. EP-A-0 738 944, which is formed by magnets included in the bezel and Reed contacts placed inside watch 1.

Moreover, it is clear that the symbols borne by rotating bezel 30 could be replaced by the names of these celestial bodies or any other representation allowing them to be identified.

It will immediately be observed, upon examining FIG. 1, that hour hand 10 has a heart-shape that is different from the ordinary shapes given to watch hands, whereas the minute hand has the conventional straight shape.

This answers a technical requirement, even if it can be linked to a concern of an aesthetic nature. Indeed, the shape of hands 10 and 12 is such that they can form a point of intersection above practically any of the points of the dial or a conjunction of their points facing one of said points. It is thus possible to address a particular point of the dial by controlling the movement of hour hand 10 and minute hand 12 in order to bring them to intersect or conjoin above that particular point. For more detail, reference can advantageously be made to the U.S. Patent Application Publication No. US 2004/0120222 A1 which is incorporated herein by reference. Moreover, it will be realised in the following description that the particular shape of the hands of watch 1 according to the invention is used to designate accurately the point in the heavens shown on rotating dial 14 where the celestial body of the solar system, selected by the user, is located.

Finally, it will be realised that an oval is added by any appropriate means such as, for example, by transfer printing, on the inside face of glass 8. This oval represents the horizon line 42, which delimits the visible part of the heavens from the place where the user of the watch is situated at a given time. The horizon line is calculated for a latitude of approximately 45° North, which enables the watch to be used with proper accuracy in North America, Europe and Asia.

This having been said, the watch of FIG. 1 operates in the following manner:

If the movement does not include position sensors, the position of hands 10, 12 and rotating dial 14 has to be initialized manually.

Initializing the position of hour hand 10 and minute hand 12 is carried out by first of all rotating bezel 30 to bring the sun symbol 34 to midday, i.e. facing the mark 24 borne by fixed scale 22. Crown 28 is then pressed for quite a long time, for example more than 10 seconds, until hands 10, 12 move, then crown 28 is pulled out into the correction position. Crown 28 is then rotated clockwise to bring hour hand 10 to midday and anti-clockwise to bring minute hand 12 also to midday. Finally, crown 28 is pushed into the normal rest position.

In order to initialize the position of rotating dial 14, in other words the map of the heavens 16, first of all bezel 30 is rotated to bring the moon phase symbol 36 to midday. Crown 28 is then pressed for more than 10 seconds, until the map of the heavens 16 moves, then crown 28 is rotated in one direction or another to bring a mark made on the map of the heavens 16 to face mark 24. Finally, crown 28 is pushed in to the normal rest position.

Initializing the position of hands 10, 12 and rotating dial 14 can also be carried out automatically. For this purpose, the hour wheel and the minute wheel each include a plate with a peripheral toothing. A device for detecting the angular position of the hour and minute wheels includes a magnetic or capacitive sensor whose detection member, namely a flat spiral coil, is used for detecting a variation in the presence of matter, particularly a conductive metal conductor forming the plate. The plates each have at least one aperture whose angular position is determined by the detection device. For more details, reference could advantageously be made to U.S. Pat. No. 6,330,207, which is incorporated by reference in the present description.

When the movement is encased, the detection device briefly described hereinbefore is activated. The apertures made in the hour and minute wheels are positioned above the detection members with an accuracy of one step, then the hour and minute hands are driven in at the midday position.

The position of rotating dial 14 can be initialized in a similar way to that of hands 10, 12. In this case, rotating dial 14 is made of a moulded plastic material and includes a metal plate whose presence is detected by an inductive sensor mounted on a printed circuit board or "PCB". The positioning accuracy of rotating dial 14, which carries the map of the heavens 16 is a function of the positioning accuracy of the metal plate and the inductive sensor.

After having initialized the position of the hour and minute hands 10 and 12 and that of rotating dial 14 carrying map of the heavens 16, the universal time constant or "UTC" and the time of the place wear the person wearing it is located can also be indicated to the watch, in order to allow said watch to determine the time zone in which the wearer is situated, and the date.

The UTC time is thus first adjusted. In order to do this, the "UTC" indication 44, which appears on rotating bezel 30, is brought to midday. It will be noted that in order to detect an angular position of rotating bezel 30, said bezel includes a certain number of permanent magnets, whereas magnetic switches of the REED contact type are arranged in the watchcase. The permanent magnets determine the open or closed binary state of the magnetic switches. The particular arrangement of the REED contacts and the permanent magnets has the effect that a particular arrangement of the REED contacts, different to the others, corresponds to each angular position of the rotating bezel, which allows unambiguous identification of the angular position occupied by said rotating bezel 30. For a full description of this device for detecting the angular position of rotating bezel 30, reference can usefully be made to U.S. Pat. No. 5,572,489, which is incorporated by reference in the present description.

After having rotated the bezel and brought the "UTC" reference to midday, crown 28 is briefly pressed. Minute hand 12 does not move, whereas hour hand 10 indicates the "UTC" time (from 1 to 24 hours) on the fixed scale 22.

From this UTC time read mode, one can enter UTC time correction mode by pulling out crown 28 into the correction position before the end of a delay time, which can be ten seconds. Minute hand 12 does not move, whereas hour hand 10 indicates the UTC time (from 1 to 24 hours) on fixed scale 22. The UTC time can then be corrected (hours and minutes) by rotating crown 28 in both directions. After correcting the UTC time, crown 28 is pushed in to its neutral rest position.

In order to be able to orient map of the heavens 16, control unit 32 of watch 1 of the invention needs to know the current date from the place where the user is located.

In order to correct the local time, crown 28 needs to be pulled out into the correction position. Minute hand 12 does not move and hour hand 10 indicates the time (from 1 to 24 hours) on fixed scale 22. Local time can then be corrected by rotating crown 28 in both directions. After correcting the local time crown 28 is pushed in to its neutral rest position hour hand 10 takes back its normal position.

In order to be able to orient the map of the heavens 16 properly, control unit 32 also needs to know the current date. The date read mode will first be examined, then the correction mode for the latter.

In order to read the date, bezel 30 is rotated in order to bring the earth symbol 40 to midday. After a brief application of pressure on crown 28, hands 10 and 12 are superposed and indicate the date from 1 to 31 on fixed scale 22.

In order to read the month, one enters the date read mode. Before the end of a time delay that can be ten seconds, bezel 30 is rotated to bring the moon phase symbol 36 to midday. Hands 10, 12 are superposed and indicate the month from 1 to 12 on fixed scale 22.

In order to read the year, one enters the date read mode. Before the end of the time delay, bezel 30 is rotated to bring the sun symbol 34 to midday. The hands are superposed and indicate the year from 1 to 60 on fixed scale 22.

In order to correct the date, the month or the year, one has to be in the date, month or year read mode. Before the time delay ends, crown 28 has to be pulled out and the value corrected by rotating said crown in both directions. After correction, crown 28 is pushed in to the neutral rest position.

Knowing the local time and the date, control unit 32 of watch 1 is able to orient the map of the heavens 16 in a suitable manner. In order to do this, control unit 32 has a memory 46 (see FIG. 3) which is a non-volatile memory programmed by the watch manufacturer and in which are stored the parameters concerning the stars and constellations, particularly the zodiac constellations, and the relative movements of the celestial bodies of the solar system with respect to the earth that the control unit needs.

Moreover, the calculations that control unit 32 has to carry out to determine the positions of the celestial bodies using the aforementioned parameters are well known to those skilled in the art and there exist numerous works which can be consulted if necessary in order to programme control unit 32 in an appropriate manner. Among such works, one can cite for example "Astronomical Algorithms" by Jean Meeus, published by Willmann-Bell, Inc. Richmond, Va. 23235, in 1991 and "Landholt-Börstein; Numerical Data and Functional Relationships in Science and Technology", group VI, volume I, Spring Verlag, Berlin 1965.

Naturally, since the watch is designed to provide other astronomical information, such as the phases of the moon, memory 46 also contains all the data necessary for control unit 32, which is also programmed for this.

The watch includes (see FIG. 3) a time base 48, a circuit for determining the current time and date 50, control unit 32 with which data memory 46 is associated, a display control circuit 52, a display system 54, formed by the hour and minute hands 10 and 12, a manual control system 56 including stem 26 and bezel 30 and a direct current voltage source, for example a battery, not shown.

Time base 48, which supplies a standard frequency signal to the time and date determination circuit 50 can advantageously be formed by a quartz oscillator like that usually used in electronic watches and which is formed by a quartz resonator and an electronic maintenance circuit, which allows the resonator to vibrate at a determined frequency.

Current time and date determination circuit 50 includes a frequency divider as well as counters for the minutes, hours, days of the month, months and years.

Moreover, circuit 50 contains the means necessary, on the one hand, for taking account of months with 28, 29, 30 and 31 days, in other words so that the watch is provided with a perpetual calendar and, on the other hand, for enabling the time and date to be corrected via control unit 32 to which this circuit is connected.

Finally, circuit 50 is also designed to provide control unit 32 and, via the latter, display control circuit 52, with all the periodic signals produced by its frequency divider and which are needed by the latter to fulfill their various functions.

Among the functions of unit 32, there is one that consists in determining, at the user's request, the positions of the various celestial bodies of the solar system other than the earth, with respect to the latter and to the stars and constellations on the current date.

When control stem 26 is in the neutral position, hands 10, 12 display the current time.

More specifically, the motors that drive hour hand 10 and minute hand 12 supply 180 pulses for one complete revolution of fixed scale 22. During normal operation of watch 1, minute hand 12 thus receives a drive pulse every 20 seconds, whereas hour hand 10 receives a drive pulse every 240 seconds During this same lapse of time, the position of these hands 10, 12 is accounted for by means of two counters, respectively for the hours and minutes, whose content is incremented by one steps of one unit from 0 to 179. the binary signals which represent the content of these counters thus allows control unit 32 of watch 1 to know the position of hour and minute hands 10, 12 at any time with respect to the position that the same hands 10, 12 would occupy during initialisation.

Rotating dial 14 is driven by a gear train whose gear reduction ratio is close to 1000, which means that the dial has to make 1000 steps to complete one revolution on itself. The gear reduction ratio is chosen to be high such that dial 14 has better resistance to rotating shocks. Likewise, such a gear reduction ratio is well suited to driving dial 14 which is relatively heavy and which has to overcome significant friction forces. Moreover, as for hands 10, 12, a counter accounts for the position of rotating dial 14, in other words of map of the heavens 16, relative to the position that the latter occupied during the initialisation step.

As previously stated, hour hand 10 has a heart-shape that differs from the usual shapes of watch hands. This particular configuration enables hour hand 10, whatever its angular position on rotating dial 14, to have a point of intersection with minute hand 12 which enables any point on the surface of said dial 14 to be designated.

Figure 2:
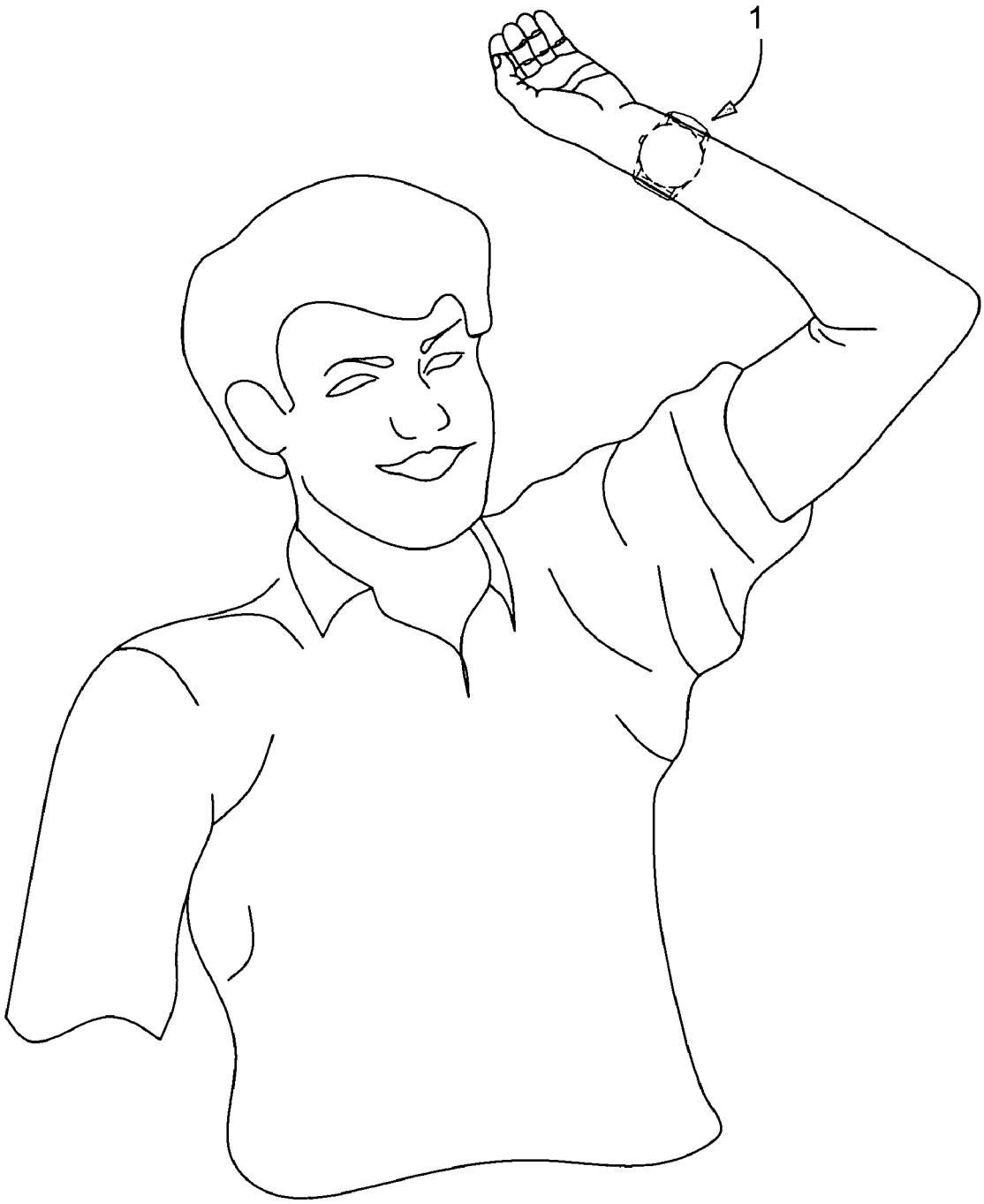
FIG. 2 is a view illustrating the way in which the watch of FIG. 1 has to be used to identify a celestial body of the solar system in the heavens.

Thus, when the user chooses one of the celestial bodies of the solar system (with the exception of the earth, which is used for the date) shown on rotating bezel 30, and brings it to midday, then he exerts a short application of pressure on crown 28, the point of intersection of hands 10, 12 will indicate the position of the celestial body on the map of the heavens 16. The user need then only look at dial 14 of watch 1 by raising his arm and ensuring that geographic North is behind him (see FIG. 2) to identify the position of the celestial body of the solar system that interests him in the heavens. In doing this, the user will be helped by the horizon line 42 that appears on glass 8, which indicates to him the part of the heavens that is visible from the place where he is located at the moment when he consults his watch.

In order to identify the position of the celestial body selected, control unit 32 has the current date, which will enable it to calculate the position occupied by said celestial body with respect to the constellations for said date. The position of the selected celestial body is identified on the surface of dial 14 by its polar coordinates, namely an angle and a radius. The position counter of map of the heavens 16 then indicates the position of said map 16 to control unit 32 and enables it to calculate the position to be given to the hands to bring them onto the desired point of dial 14.

It goes without saying that the present invention is not limited to the embodiment that has just been described and that various simple modifications and variants can be envisaged by those skilled in the art without departing from the scope of the invention.

What is claimed is:

1. An electronic astronomical watch, capable of indicating position of celestial bodies in the heavens, said watch including:

a time base for producing a standard frequency signal;

means for determining the current time and date from the standard signal;

means for selecting a celestial body;

analogue time display means using two hands;

means for determining the position of the selected celestial body in the heavens and indicating this position via the display means; and a rotating dial on which there is shown a map of the heavens and wherein a shape of the hands of the analogue time display means is such that an intersection or point of conjunction of the hands enables any point of the map of the heavens to be designated on the dial.

2. The watch according to claim 1, wherein the map of the heavens is a diagram of the stars and constellations, visible from the earth.

3. The watch according to claim 1, wherein the watch enables the position of the planets of the solar system to be identified.

4. The watch according to claim 1, wherein the watch includes a glass onto which a horizon line is added that indicates to a user, at any time, which of the constellations are visible from the place where the user is located.

5. The watch according to claim 1, wherein the rotating dial completes one revolution in 23 hours 56 minutes and 4.09 seconds.

6. The watch according to claim 1, wherein the watch includes a rotating control stem that can be moved between three positions, namely a stable neutral position that corresponds to a normal operation of the watch, a pulled out position that is also stable and an unstable pushed in position in which a return spring permanently tends to return the stem to the neutral position.

7. The watch according to claim 1, wherein the watch includes a rotating bezel that carries symbols of the celestial bodies and whose position can be identified by means of magnets included in the bezel and REED contacts placed inside the watch.

8. The watch according to claim 7, wherein a fixed scale carried by a flange is arranged concentrically between the rotating dial and the rotating bezel.

9. The watch according to claim 1, wherein map of the heavens is established for a latitude of 45° North.

10. The watch according to claim 1, wherein the time base is formed by a quartz oscillator including a quartz resonator and an electronic maintenance circuit that enables the resonator to vibrate at a determined frequency.

11. The watch according to claim 1, wherein the means for determining the current time and date includes a frequency divider as well as counters for the minutes, hours, days of the month, months and years.

12. The watch according to claim 1, wherein the watch is a wristwatch.

13. The watch according to claim 2, wherein the constellations are zodiac constellations.

14. An electronic astronomical watch capable of indicating position of celestial bodies in the heavens, said watch including:

a time base for producing a standard frequency signal;

means for determining the current time and date from the standard signal;

means for selecting a celestial body;

analogue time display means using two hands;

means for determining the position of the selected celestial body in the heavens and indicating this position via the display means; and a rotating dial on which is shown a map of the heavens and wherein a shape of the hands of the analogue time display means is such that an intersection or point of conjunction of the hands enables any point of the map of the heavens to be designated on the dial, wherein the means for determining the position of the celestial bodies and indicating this position via the display means includes a control unit associated with a memory in which there is stored parameters, concerning the constellations and relative movements of the celestial bodies with respect to the earth, needed by the control unit for calculating the position of a celestial body at a given date.

* * * * *